US007404393B2

(12) United States Patent
Moore

(10) Patent No.: US 7,404,393 B2
(45) Date of Patent: Jul. 29, 2008

(54) FUEL INJECTION SYSTEM

(75) Inventor: Matthew E Moore, Thame (GB)

(73) Assignee: Delphi Technologies, Inc., Troy, MI (US)

( * ) Notice: Subject to any disclaimer, the term of this patent is extended or adjusted under 35 U.S.C. 154(b) by 164 days.

(21) Appl. No.: 10/520,257

(22) PCT Filed: Jun. 20, 2003

(86) PCT No.: PCT/GB03/02670

§ 371 (c)(1),
(2), (4) Date: Aug. 15, 2005

(87) PCT Pub. No.: WO2004/005700

PCT Pub. Date: Jan. 15, 2004

(65) Prior Publication Data

US 2006/0150954 A1 Jul. 13, 2006

(30) Foreign Application Priority Data

Jul. 4, 2002 (GB) ..... 0215488.8

(51) Int. Cl.
*F02M 37/04* (2006.01)

(52) U.S. Cl. ..... 123/446; 123/467

(58) Field of Classification Search ..... 123/446, 123/447, 456, 467, 500, 501, 514, 506, 299, 123/300

See application file for complete search history.

(56) References Cited

U.S. PATENT DOCUMENTS 4,069,800 A 1/1978 Kanda et al.
5,413,076 A 5/1995 Koenigswieser et al.
5,915,361 A 6/1999 Heinz et al.
6,283,441 B1 9/2001 Tian
6,520,152 B1 * 2/2003 Mahr et al. ..... 123/447
6,536,416 B1 * 3/2003 Mahr et al. ..... 123/506

FOREIGN PATENT DOCUMENTS

| | | |
|---|---|---|
| DE | 4118237 | 12/1991 |
| DE | 19956598 | 6/2001 |
| EP | 0691471 | 11/1998 |
| GB | 2353327 | 2/2001 |
| WO | WO 00/55496 | 9/2000 |
| WO | WO 01/14726 | 3/2001 |
| WO | WO 01/52916 | 7/2001 |
| WO | WO 02/055869 | 7/2002 |

* cited by examiner

*Primary Examiner*—Carl S. Miller
(74) *Attorney, Agent, or Firm*—David P. Wood

(57) ABSTRACT

A fuel injection system comprising an accumulator volume (10) arranged to be charged with fuel by means of a high pressure fuel pump (12) and for supplying fuel at a first injectable pressure level to a plurality of fuel injectors (22), wherein each injector (22) includes a delivery passage (16, 20), a valve needle (30), which is engageable with a seating to control fuel injection, and a control valve (26) for controlling fuel pressure within a control chamber (28) so as to control movement of the valve needle (30). The control valve (26) has a first operating position in which the control chamber (28) communicates with a low pressure drain and communication between the control chamber (28) and the delivery passage (16, 20) is prevented and a second operating position in which the control chamber (28) communicates with the delivery passage (16, 20) and communication between the control.

12 Claims, 7 Drawing Sheets

FUEL INJECTION SYSTEM

Figure 1:
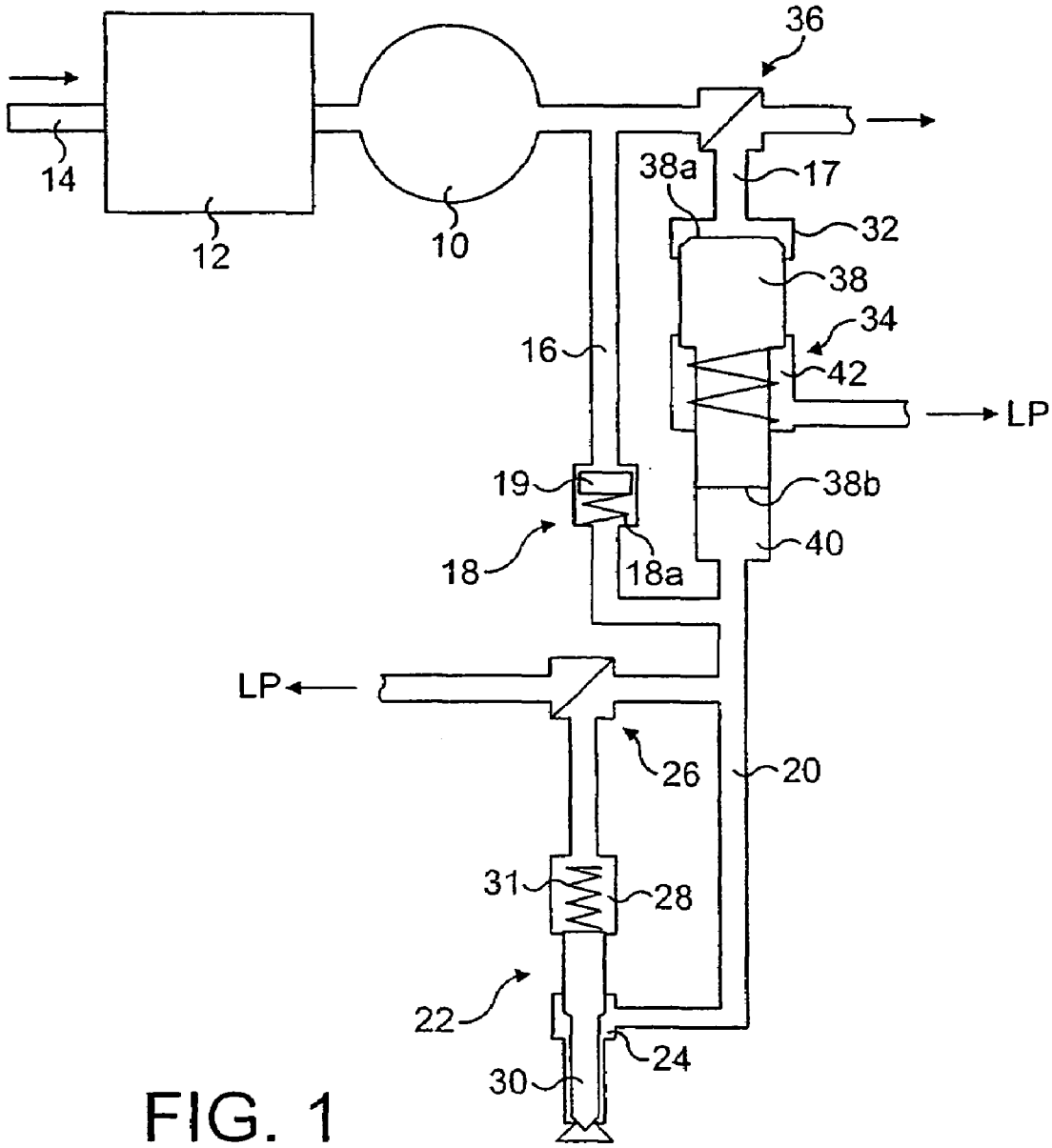

The invention relates to a fuel injection system for use in supplying high pressure fuel to a compression ignition internal combustion engine.

Known common rail fuel systems include an accumulator volume or rail which is charged with fuel at high pressure by means of a high pressure fuel pump. Fuel at high pressure is supplied by the common rail to a plurality of injectors, each of which is arranged to inject fuel into an associated engine cylinder.

It is desirable to be able to vary the injection characteristic of the injected fuel spray. In particular, for emissions purposes it is beneficial to provide a pilot injection of fuel at a relatively low injection rate followed by a main injection of fuel at a higher rate. A pilot/main injection sequence also has benefits for engine combustion noise. It is also thought to be of particular advantage to provide a main injection of fuel having a so-called "boot-shaped" injection rate. A boot-shaped injection rate characteristic comprises an initial relatively low injection rate of short duration followed immediately by a higher injection rate. Providing a higher rate main injection of fuel followed by a post injection of fuel is also known to provide emissions benefits.

By way of background to the present invention, WO 01/14726A1 describes a common rail fuel system in which an accumulator volume or common rail is charged with fuel at high pressure by means of a high pressure fuel pump. Fuel within the accumulator volume is distributed to a plurality of injection nozzles, each of which has an associated intensifier arrangement. Each intensifier arrangement serves to further increase the pressure of fuel supplied from the common rail and delivers fuel at increased pressure to the associated injection nozzle through a high pressure supply passage.

Each injection nozzle has a valve needle which is biased towards a closed position in which it is seated against a valve seating by means of a spring. In order to commence injection, the valve needle is moved away from the seating, against the spring force, by varying fuel pressure within a control chamber arranged at a back end of the needle. The control chamber communicates continuously with the high pressure supply passage and fuel pressure within the control chamber is controlled by means of a two-way nozzle control valve. The nozzle control valve is operable between an open position, in which the control chamber communicates with a low pressure drain, and a closed position in which communication between the control chamber and the drain is broken.

In order to provide an injection of fuel, the nozzle control valve is opened to permit fuel within the control chamber to escape to low pressure, thereby causing fuel pressure within the nozzle control chamber to be reduced. A point will be reached at which the force due to fuel pressure acting on thrust surfaces of the valve needle is sufficient to overcome the force due to fuel pressure within the control chamber, which acts in combination with the spring force, and the valve needle lifts from its seating. Closure of the valve needle is effected by closing the nozzle control valve to re-establish high pressure fuel within the control chamber.

A problem with the aforementioned system is that, when the nozzle control valve is opened to lift the valve needle, there is a continuous flow of high pressure fuel between the high pressure supply passage and the low pressure drain, and therefore a proportion of high pressure fuel is wasted. The parasitic losses of the system are therefore relatively high.

It is an object of the present invention to provide an improved fuel injection system which permits the fuel injection characteristic, and in particular the injection rate, to be varied and which overcomes or alleviates the aforementioned problem of the prior art.

According to the present invention there is provided a fuel injection system comprising;

an accumulator volume arranged to be charged with fuel by means of a high pressure fuel pump and for supplying fuel at a first injectable pressure level to a plurality of fuel injectors, wherein each injector includes a delivery passage, a valve needle, which is engageable with a seating to control fuel injection, and a control valve for controlling fuel pressure within a control chamber so as to control movement of the valve needle, wherein the control valve has a first operating position in which the control chamber communicates with a low pressure drain and communication between the control chamber and the delivery passage is prevented and a second operating position in which the control chamber communicates with the delivery passage and communication between the control chamber and the low pressure drain is prevented, and wherein each injector has an associated intensifier arrangement for increasing the pressure of fuel to be supplied to the injector to a second, injectable pressure level and including intensifier control valve means, which is operable to determine whether fuel injected to the engine is at the first or second injectable pressure level.

The present invention provides the advantage that the injection characteristic, and in particular the injection pressure and, hence, the injection rate can be varied by operating the intensifier control valve means between first and second operating states. It has been found that emission levels benefit from an injection event comprising a pilot injection of fuel at a relatively low injection rate, followed by a main injection of fuel at a higher rate. The present invention provides a convenient means of achieving this as the intensifier control valve means can be switched relatively rapidly to switch the injected pressure level between the low and high rates. The fuel system also enables a boot-shaped injection rate to be achieved, which is also found to have advantages for emissions levels.

It is a further advantage of the present invention that parasitic fuel losses are minimised, due to the provision of the three-way nozzle control valve. By providing the intensifier arrangement, the high pressure fuel pump for charging the accumulator volume need only be capable of pressurising fuel to a relatively low injectable pressure.

The intensifier arrangement may include an intensifier piston having a pressure control chamber, wherein the intensifier control valve is operable to control fuel pressure within the pressure control chamber.

In one embodiment the pressure control chamber is defined at one end of the intensifier piston.

For example, the intensifier piston may have a first surface area exposed to fuel pressure within the pressure control chamber and a second surface area exposed to fuel pressure within an intensifier chamber, wherein the first surface area is greater than the second surface area, thereby to permit fuel pressure within the intensifier chamber to be increased to the second injectable pressure level.

In an alternative embodiment, the pressure control chamber may be an intermediate chamber of the intensifier arrangement, defined between opposing ends of the intensifier piston. More preferably, an intensifier chamber is arranged at one end of the intensifier piston and within which fuel pressure is increased to the second injectable pressure level in circumstances in which fuel pressure within the intermediate chamber is reduced to less than the first pressure level.

The system further includes a non-return valve arranged within a high pressure supply passage through which fuel is supplied from the accumulator volume to the injector delivery passage.

Preferably, the accumulator volume is charged with fuel at a first pressure level of around 300 bar, in use, and the intensifier arrangement is arranged so as to provide fuel at a second pressure level in excess of 2000 bar.

In one embodiment, the intensifier arrangement is arranged within a housing common to the associated injector. The common housing may be formed from several separate housing parts. In a further preferred embodiment, the intensifier control valve means includes a valve member which is substantially axially aligned with the intensifier piston within the common housing and/or with the valve needle.

Figure 2:
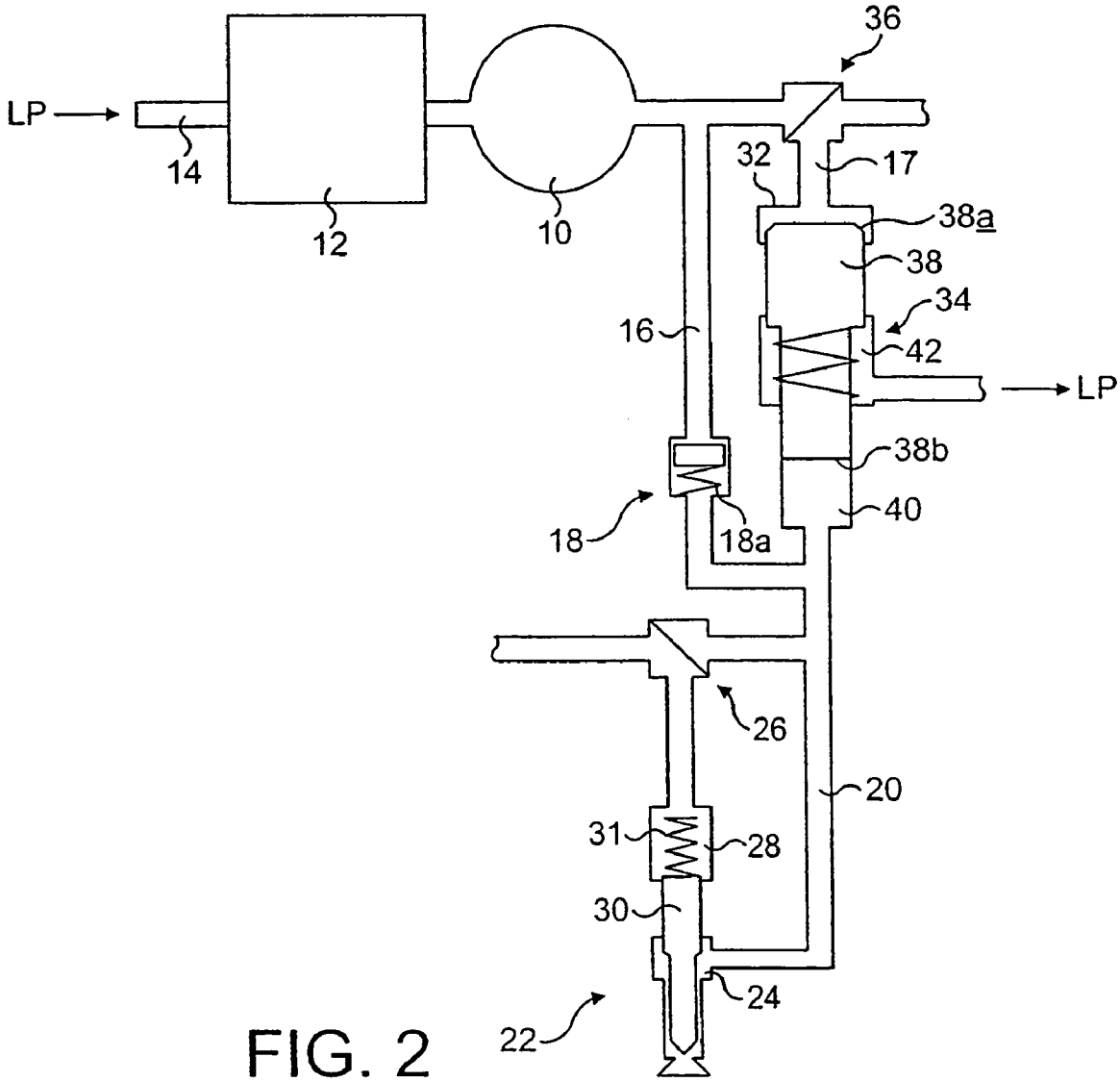
Figure 3:
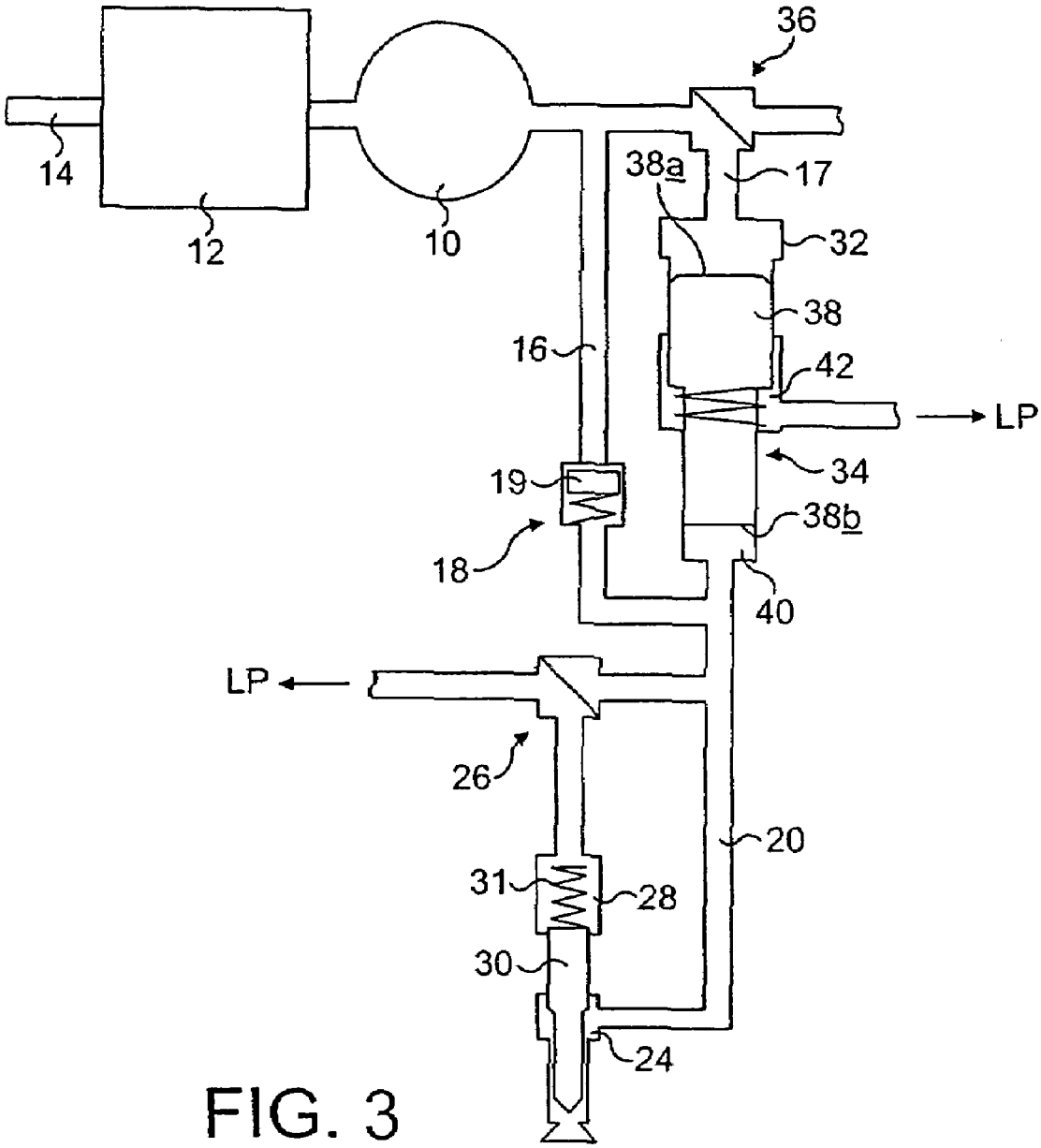
Figure 4A:
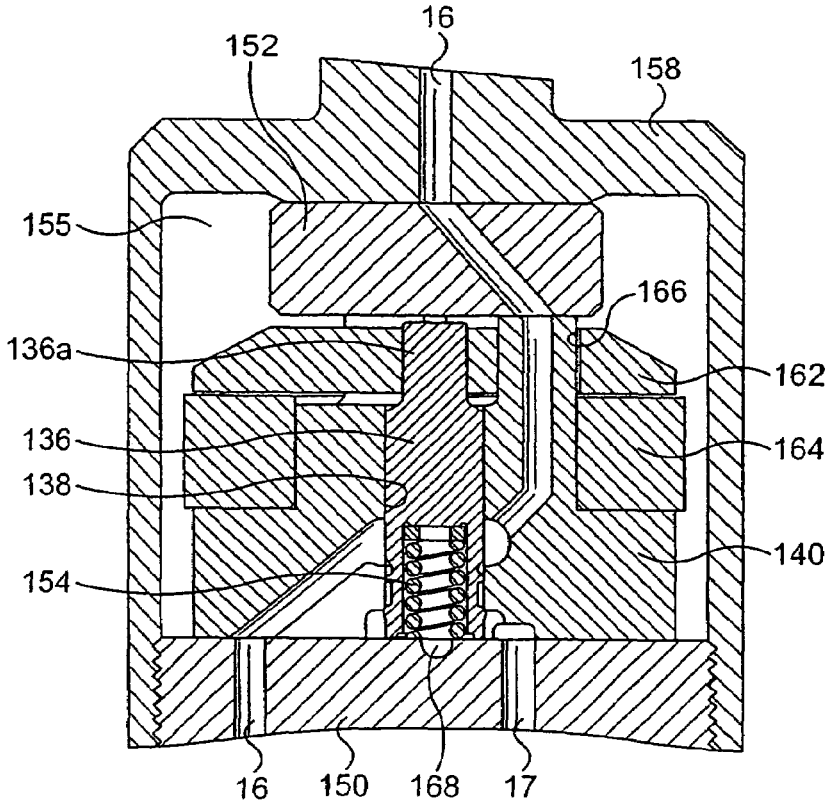
Figure 4B:
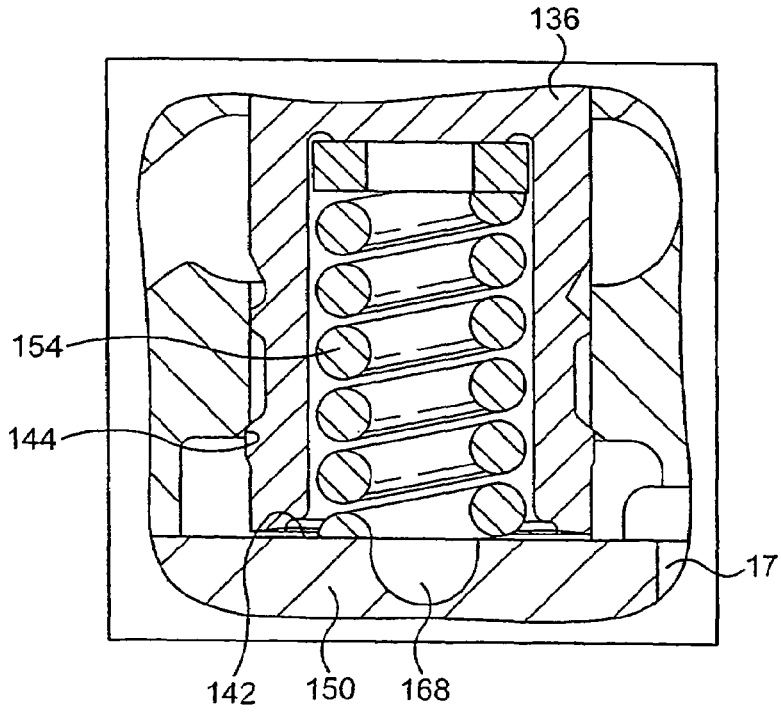

The invention will now be described, by way of example only, with reference to the accompanying drawings in which:

FIG. 1 is a schematic diagram of a first embodiment of the fuel system when in a first operating condition, FIG. 2 illustrates the system in FIG. 1 when in a second operating condition, FIG. 3 shows the system in FIGS. 1 and 2 when in a third operating condition, FIGS. 4(*a*) and 4(*b*) are an enlarged views of an intensifier control valve and a part thereof respectively, which forms part of the fuel system in FIGS. 1 to 3,.

Figure 5:
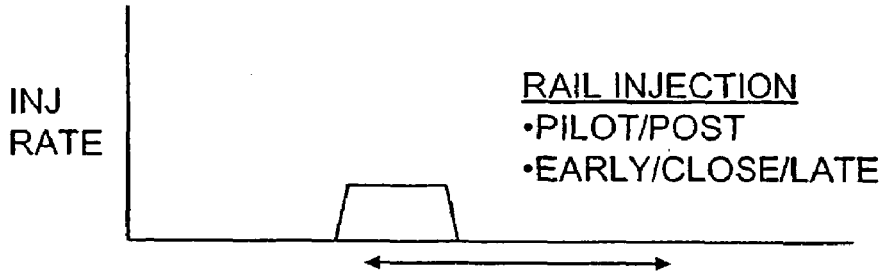
Figure 6:
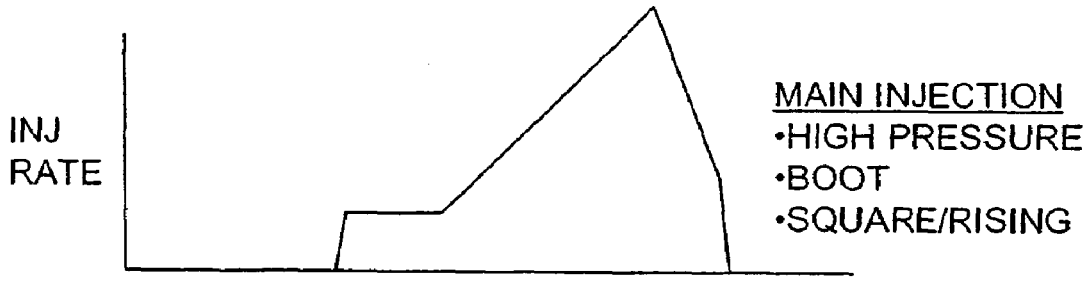
Figure 7:
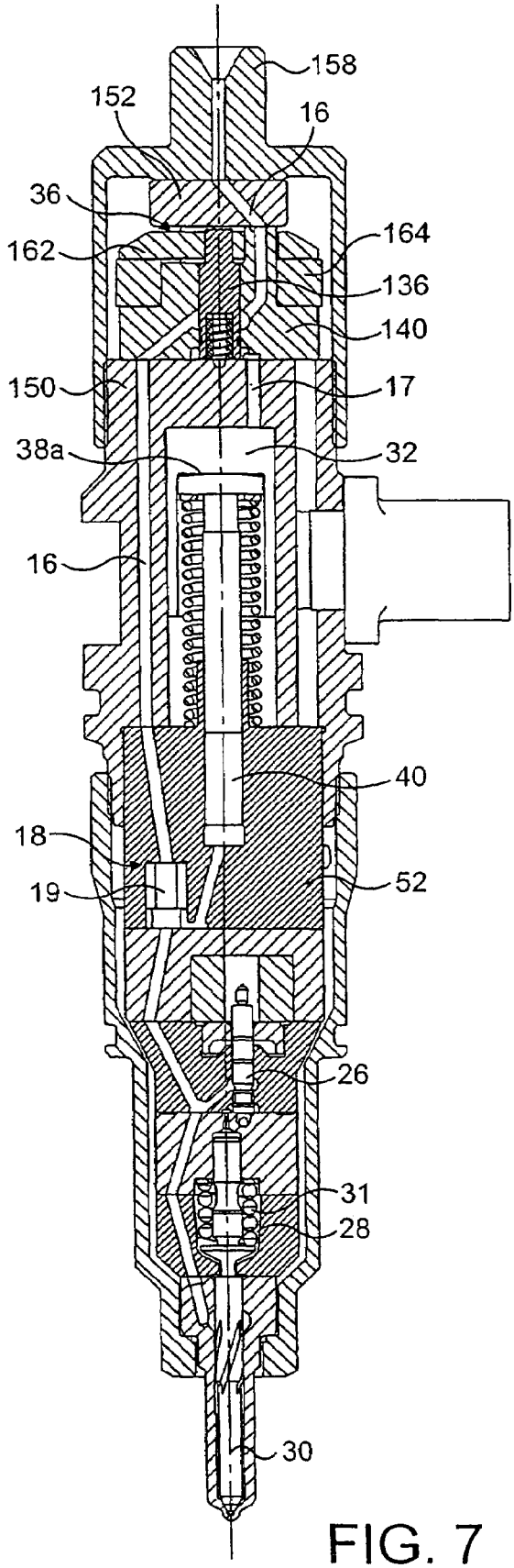

FIG. 5 is a graph to show the injection rate for a pilot injection of fuel at a first fuel pressure level, FIG. 6 is a graph to show the injection rate for a main injection of fuel at a second, higher fuel pressure level, FIG. 7 is a sectional view of a practical embodiment of a part of the fuel system in FIGS. 1 to 3, and FIG. 8 is a schematic diagram of an alternative embodiment to that shown in FIGS. 1 to 3.

Referring to FIG. 1, the fuel system of the present invention includes an accumulator volume or common rail 10, which is charged with fuel at high pressure by means of a high pressure fuel pump 12. Typically, fuel pressure within the common rail is pressurised to a level of around 300 bar. The fuel pump 12 receives fuel at relatively low pressure through an inlet 14. The common rail 10 supplies fuel at a first pressure level to a high pressure supply passage 16, and is arranged to deliver fuel to a delivery line or delivery passage 20 of an associated fuel injector, referred to generally as 22. In practice a plurality of fuel injectors will be provided, one for each engine cylinder, but for simplicity only one of these will be described in detail.

The high pressure supply passage 16 is provided with a non return valve 18 including a valve member 19 which is engageable with a non return valve seating to control flow though the high pressure supply passage 16. The non return valve 18 is provided with a spring 18*a* which tends to close the non return valve. Upon pressurisation of fuel within the common rail 10 a force is applied to the non return valve member 19 which serves to urge the non return valve into an open position, against the force of the spring 18*a*, to permit fuel to flow through the high pressure supply passage 16 and into the delivery line 20. Should fuel pressure within the delivery line 20 increase beyond a predetermined level, the non return valve member 19 will be urged to close to prevent a return flow of fuel from the delivery line 20 to the common rail 10.

The delivery line 20 communicates directly with a delivery chamber 24 of the fuel injector 22, and with a low pressure drain under the control of a nozzle control valve 26. The nozzle control valve 26 is operable under the control of an actuator (not shown), for example an electromagnetic or piezoelectric actuator, so as to control communication between a control chamber 28 of the injector and the low pressure drain. The injector 22 further includes a valve needle 30, which is urged towards a valve needle seating (not shown) by means of a valve needle spring 31 acting in combination with the hydraulic force due to fuel pressure within the control chamber 28. When the valve needle 30 is in its seated position, fuel injection into the engine cylinder does not take place.

The nozzle control valve 26 is actuable between a closed position, in which the delivery line 20 communicates with the control chamber 28 and communication between the control chamber 28 and the low pressure drain is broken, and an open position in which communication between the control chamber 28 and the low pressure drain is open and fuel flow from the delivery line 20 into the control chamber 28 is prevented.

The common rail 10 also supplies fuel to a pressure control chamber 32 of an intensifier arrangement, referred to generally as 34. The intensifier arrangement 34 includes an intensifier control valve means 36 having an actuable valve member (not shown), and further including an intensifier piston 38 having a first end 38*a* exposed to fuel pressure within the pressure control chamber 32 and a second end 38*b* exposed to fuel pressure within an intensifier chamber 40 at the end of the piston 38 remote from the pressure control chamber 32. An intensifier piston feed passage 17 from the intensifier control valve 36 communicates with the pressure control chamber 32 of the intensifier arrangement. A further chamber 42 intermediate the pressure control chamber 32 and the intensifier chamber 40 communicates with the low pressure drain and permits any fuel leakage from the pressure control chamber 32 and/or the intensifier chamber 40 to flow past the piston 38 and into the further chamber 42 to escape to low pressure and, thus, to prevent the occurrence of a hydraulic lock.

The first end 38*a* of the piston 38 has a larger effective surface area exposed to fuel within the pressure control chamber 32 than the area of the second surface 38*b* exposed to fuel within the intensifier chamber 40. The intensifier arrangement 34 therefore provides a hydraulic amplification effect, to increase fuel pressure within the intensifier chamber 40 to a second pressure level, which is higher than the pressure level within the common rail 10. Typically, fuel pressure within the intensifier chamber 40 is increased to a level in excess of 2000 bar.

The fuel system in FIG. 1 permits fuel to be injected into the engine either at the first relatively high pressure level within the common rail 10, or at the second, higher pressure level within the intensifier chamber 40, depending upon the position of the intensifier control valve 36. In use, with the intensifier control valve 36 in a closed position (as shown in FIG. 1), fuel within the common rail 10 is unable to flow through the intensifier control valve 36 into the piston feed passage 17 and into the pressure control chamber 32. Fuel pressure within the pressure control chamber 32 therefore remains at a relatively low level. The flow of fuel from the common rail 10 urges the non return valve 18 to open, so that fuel from the common rail 10 is supplied through the high pressure supply passage 16, into the delivery line 20 of the injector. In this operating condition, fuel pressure within the intensifier chamber 40 is at the first pressure level supplied by the rail 10.

With the nozzle control valve 26 in its closed position (as shown in FIG. 1), a supply of high pressure fuel flows into the control chamber 28 at the back of the valve needle 30 and, in combination with the force of the spring 31 serves to urge the valve needle 30 into engagement with its seating to prevent injection.

If it is required to inject fuel at the first pressure level, the nozzle control valve 28 is moved to its open position to close communication between the delivery line 20 and the control chamber 28, and to open communication between the control chamber 28 and the low pressure drain. In such circumstances fuel within the control chamber 28 is able to flow to low pressure, thereby reducing the force acting on the back end of the valve needle 30. As a consequence of this the valve needle 30 is urged away from its seating due to high fuel pressure within the delivery chamber 24 to permit fuel injection to the engine at the first pressure level.

To terminate injection at the first pressure level, the nozzle control valve 26 is returned to its closed position, breaking communication between the control chamber 28 and the low pressure drain and opening communication between the delivery line 20 and the control chamber 28. High pressure fuel is reestablished within the control chamber 28 to re-seat the valve needle 30. FIG. 2 shows the fuel system of FIG. 1 when in the first injecting state, in which the valve needle 30 is lifted from its seating and fuel at the first pressure level is injected to the engine.

If it is required to inject fuel at the second, higher level, the intensifier control valve 36 is actuated to move into an open position in which fuel at the first pressure level is supplied from the high pressure supply passage 16, to the piston feed passage 17 and into the pressure control chamber 32. Fuel pressure within the pressure control chamber 32 is therefore increased, and the piston 38 is urged in a downward direction (as shown in FIG. 3). Due to the differential area between the first surface 38*a* of the piston 38 exposed to fuel pressure within the pressure control chamber 32 and the area 38*b* of the second end of the piston 38 which is exposed to fuel pressure within the intensifier chamber 40, fuel pressure within the intensifier chamber 40 is caused to increase to a second, higher pressure level. It will be appreciated that the differential areas of the first and second ends 38*a*, 38*b* of the piston 38 provide a hydraulic amplification effect to increase fuel pressure in the intensifier chamber 40 to the second pressure level. Typically, pressure within the intensifier chamber 40 is increased to a level in excess of 2,000 bar, and preferably between 2400 and 2500 bar.

As fuel pressure within the intensifier chamber 40 is increased, the non return valve member 19 will be urged closed, thereby terminating the flow of fuel between the high pressure supply passage 16 and the delivery line 20, and trapping higher pressure fuel within the delivery line 20. In order to inject fuel at this second, higher pressure level, the nozzle control valve 26 is opened to relieve fuel pressure within the control chamber 28, thereby causing the valve needle 30 to lift, as described previously.

FIGS. 4(*a*) and (*b*) show enlarged views of the intensifier control valve 36 of the system in FIGS. 1 to 3. The valve 36 takes the form of a two position valve having two control seats and includes a valve pin, or valve member 136. The valve member 136 is movable within a bore 138 provided in a valve housing 140, a lower surface of which abuts an upper surface of an intensifier housing 150. The upper surface of the valve housing 140 abuts an insert 152 provided with a drilling that forms part of the supply passage 16. The insert 152 and the valve housing 140 are located within a housing space 155 defined by a recessed outlet housing 158 provided with a further drilling, to align with that in the insert 152, so as to define a further part of the supply passage 16.

The valve member 136 includes an upper region of reduced diameter that is attached or otherwise coupled to an armature 162 of an electromagnetic actuator arrangement. The actuator arrangement includes a winding or solenoid 164 which is energisable so as to cause movement of the armature 162, and hence of the valve member 136, to move the valve member 136 between first and second control seats 142, 144. The armature 162 is provided with a through drilling 166 through which a region of the valve housing 140 extends, this region defining a further portion of the high pressure supply passage 16.

The valve member 136 is engageable with the second valve seating 144 to control whether fuel is able to flow through the valve 36 between the high pressure supply passage 16 and the piston feed passage 17. The valve member 136 is engageable with the first valve seating 142 to control whether the piston feed passage 17 instead communicates with a low pressure drain passage 168 defined, in part, within an upper region of the intensifier housing 150. The first valve seating 142 is defined by an upper surface of the intensifier housing 150 and it is a lower end surface of the valve member 136 which engages with this surface. The second valve seating 144 is defined by a frusto-conical surface of the bore 138 within which the valve member 136 moves.

As can be seen most clearly in FIG. 4(*b*), the valve member 136 is shaped to define a chamber which houses a valve spring 154. The spring 154 serves to urge the valve member 136 into a position in which it is engaged with the second valve seating 144.

In use, when the actuator is de-energised, the force due to the spring 154 is sufficient to seat the valve member 136 against the second valve seating 144. In this position fuel flow between the high pressure supply passage 16 and the piston feed passage 17 is prevented, corresponding to the closed operating state of the intensifier control valve 36 (FIG. 1). Under such circumstances, high pressure fuel within the supply passage 16 is unable to flow through the control valve 36. Instead, as the valve member 136 is spaced away from the first valve seating 142, the piston feed passage 17 communicates with the low pressure drain passage 168 so that fuel pressure within the pressure control chamber 32 is low. As described previously, the flow of fuel from the common rail 10 urges the non return valve 18 of the system to open, so that fuel from the common rail 10 is supplied through the high pressure supply passage 16 and into the delivery line 20 of the injector. In this operating condition, fuel pressure within the intensifier chamber 40 is at the first pressure level supplied by the rail 10.

When the winding 164 is energised, the armature 162 is caused to move against the force of the valve spring 154, causing the valve member 136 to be urged away from the second valve seating 144 into engagement with the first valve seating 142. As a result, high pressure fuel delivered to the supply passage 16 is able to flow past the second valve seating 144 into the piston feed passage 17 and, hence, into the pressure control chamber 32. This corresponds to the operating condition of the fuel system illustrated in FIG. 3, in which fuel at the second, higher pressure level may be injected. With the valve member 136 seated against the first valve seating 142 it will be appreciated that communication between both the piston feed passage 17 and the low pressure drain passage 168, and between the supply passage 16 and the low pressure drain passage 168, is broken.

In both operating positions of the valve 36, high pressure fuel in the supply passage 16 is unable to flow to the low pressure drain passage 168 as when the valve member 136 is moved against the first valve seating 142 to break communication between the piston feed passage 17 and the drain passage 168, there is also no communication between the supply passage 16 and the drain passage 168. The two position two-seat intensifier control valve therefore provides the benefit that parasitic fuel losses are minimised or substantially avoided.

The present invention provides a means of injecting fuel at two, high pressure levels under the control of the intensifier control valve 36. The system is particularly beneficial in that it enables a pilot injection of fuel to be delivered at a lower injection rate followed by a subsequent, main injection of fuel at a higher rate. It has been found that this sequence benefits the emissions levels and provides advantages for engine combustion noise.

FIGS. 5 and 6 show an example of the injection rate for a pilot injection of fuel and for a main injection of fuel respectively. In FIG. 6, the main injection of fuel has a so-called "boot-shaped" injection rate, comprising an initial square shaped injection rate followed by a rising injection rate. In order to achieve the boot-shaped main injection, the intensifier control valve 36 is moved from its closed state (as shown in FIG. 2) to its open state (as shown in FIG. 3) without re-seating the valve needle 30 (i.e. keeping the nozzle control valve 26 open).

It will be appreciated that alternative combinations or sequences of a lower rate injection and a higher rate injection are also possible using the system described with reference to FIGS. 1 to 4. For example, a boot-shaped main injection of fuel may be followed by a lower rate post injection of fuel, or followed by a late post injection of fuel for after treatment purposes.

As the common rail 10 need only be charged to a moderately high pressure (e.g. 300 bar) the demands on the high pressure pump are reduced. Furthermore, as the intensifier arrangement 34 is driven by this moderate rail pressure, without the need for a cam drive, the limitation on injection timing in known systems is avoided. FIG. 7 shows a practical embodiment of a part of the fuel system in FIGS. 1 to 3, in which the nozzle control valve 26, the intensifier arrangement 34 and the two position intensifier control valve 36 are all housed within a common housing unit. The intensifier arrangement 34 is housed within an intensifier housing 150 though which a part of the high pressure supply passage 16 extends. The intensifier housing 150 abuts a lower housing 52 through which a portion of the high pressure supply passage 16 also extends. The non return valve 18 is mounted within a region of the high pressure supply passage 16 within the lower housing 52. The valve member 136 of the intensifier control valve 36 is axially aligned with the intensifier piston 38 and the valve needle 30. The arrangement of parts shown in FIG. 7 is particularly advantageous as it is relatively compact and can easily be incorporated into existing engine designs.

Figure 8:
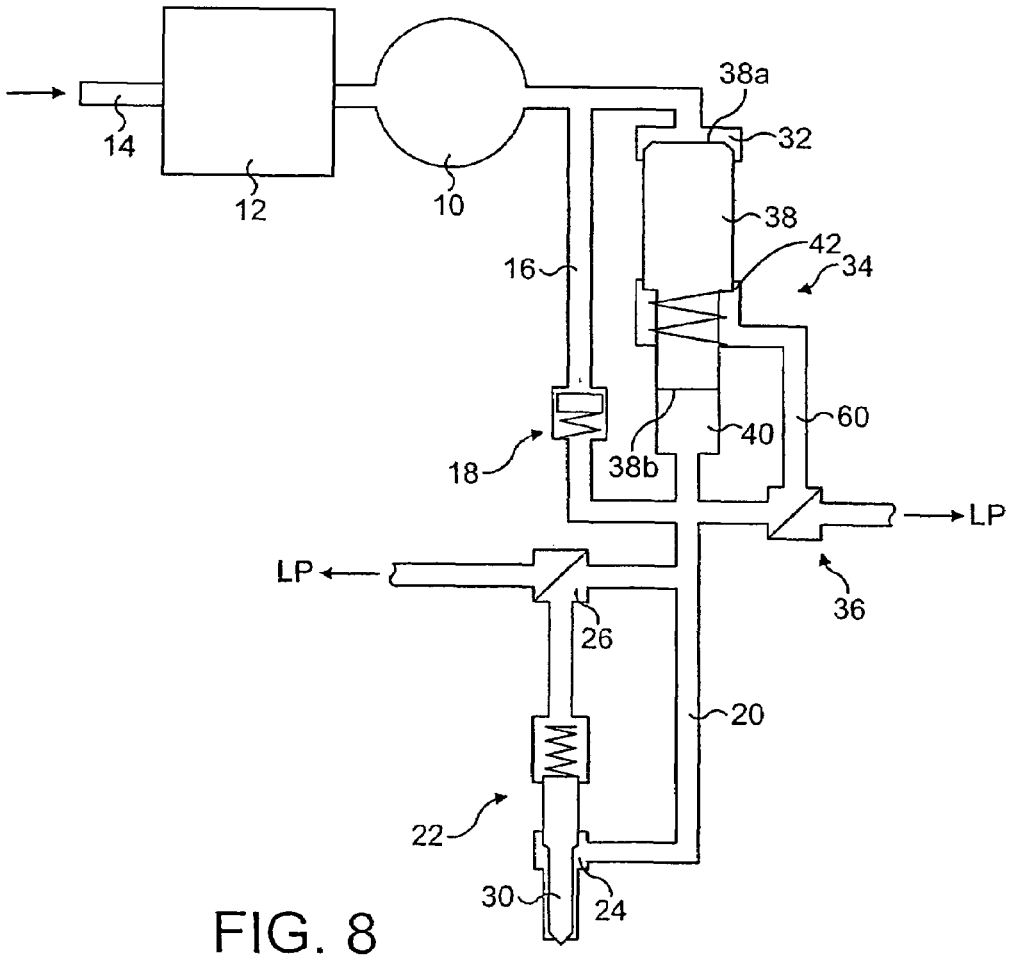

FIG. 8 shows an alternative embodiment of the fuel injection system to that shown in FIGS. 1 to 3, in which the three-way two-seat intensifier control valve 36 is located in a different position within the hydraulic circuit. Similar parts to those shown in FIGS. 1 to 3 have been identified by like reference numerals, and so will not be described in further detail. In FIG. 8, the intermediate chamber 42 of the intensifier piston arrangement 34 communicates through a control passage 60 with the supply passage 16 and the delivery line 20 to the injector. The control passage 60 is provided with the intensifier control valve 36, which again takes the form of a three-way, two control-seat valve operable between open and closed positions. In its closed position, communication between the intermediate chamber 42 and the low pressure drain is closed and communication between the intermediate chamber 42 and the delivery line 20 is open. When the valve 36 is in its open position, communication between the intermediate chamber 42 and the low pressure drain is open and communication between the intermediate chamber 42 and the delivery line 20 is closed. It will be appreciated that the intensifier control valve 36 is a three way valve, as described with reference to FIGS. 4(*a*) and 4(*b*), and so when the valve 36 is in its closed position communication between the delivery line 20 and the low pressure drain is also prevented to minimise parasitic fuel losses through the valve 36.

As described previously, the common rail 10 supplies fuel at the first pressure level to the supply passage 16 and delivery line 20 to the injector 22. As the intensifier valve 36 no longer controls communication between the rail 10 and the pressure control chamber 32, the pressure control chamber 32 is in constant communication with fuel at the first pressure level that is supplied by the common rail 10.

With the intensifier valve 36 in its closed position (i.e. connection to drain closed), fuel pressure within the pressure control chamber 32 and within the intensifier control chamber 40 is at the first pressure level and, due to communication between the intermediate chamber 42 and the delivery line 20, fuel pressure within the intermediate chamber 42 is also at the first pressure level. In such circumstances, if the nozzle control valve 26 is actuated into its open position then fuel at the first pressure level is therefore injected to the engine cylinder.

If it is required to inject fuel at the second pressure level, the intensifier control valve 36 is moved into its open position in which the intermediate chamber 42 is brought into communication with the low pressure drain, and in which communication between the intermediate chamber 42 and the delivery line 20 is broken. In such circumstances, the pressure of fuel supplied to the pressure control chamber 32 (at the first pressure level) overcomes the reduced force in the intermediate chamber 42, so as to cause the intensifier piston 38 to be moved in a downward direction (in the illustration shown), reducing the volume of the intensifier chamber 40 and causing fuel pressure in the chamber 40 to increase through hydraulic amplification. The pressure of fuel supplied to the injector 22 is therefore increased to a second pressure level) and injection at this second pressure level may be effected by actuating the nozzle control valve 26 to open.

It will be appreciated that the difference between the embodiment of FIGS. 1 to 3 and that of FIG. 8 is that the intensifier control valve 36 in FIG. 8 controls fuel pressure within a chamber to which 'thrust' surfaces in a mid-region of the intensifier piston are exposed, whereas in FIGS. 1 to 3 it is a thrust surface (i.e. 38*a*) defined by an end region of the intensifier piston that is exposed to control pressure. It is one benefit of the embodiment in FIG. 8 that the intensifier control valve 36 can be located conveniently within the same housing as the nozzle control valve 26, therefore providing a compact and lightweight injection unit.

The invention claimed is:

1. A fuel injection system comprising:

an accumulator volume arranged to be charged with fuel by means of a high pressure fuel pump and for supplying fuel at a first injectable pressure level to a plurality of fuel injectors, and a non-return valve arranged within a high pressure supply passage through which fuel is supplied from the accumulator volume directly to a delivery passage of each fuel injector, wherein each fuel injector further includes a valve needle which is engageable with a seating to control fuel injection, and a control valve for controlling fuel pressure within a control chamber so as to control movement of the valve needle, the control valve having a first operating position in which the control chamber communicates with a low pressure drain and communication between the control chamber and the delivery passage is prevented, and a second operating position in which the control chamber communicates with the delivery passage and communication between the control chamber and the low pressure drain is prevented, and wherein each injector has an associated intensifier arrangement for increasing the pressure of fuel to be supplied to the injector to a second injectable pressure level, the intensifier arrangement including an intensifier control valve which is operable to determine whether fuel injected to the engine is at the first or second injectable pressure level, and an intensifier piston having a pressure control chamber and an intensifier chamber, wherein the intensifier control valve is operable to control fuel pressure within the pressure control chamber and, hence, to control fuel pressure within the intensifier chamber, the intensifier control valve having first operating position, in which the accumulator volume communicates with the pressure control chamber via the supply passage and the non-return valve such that operation of the intensifier arrangement is prevented and fuel is supplied to the injector, while bypassing said intensifier arrangement at the first injectable pressure level, and a second operating position, in which the pressure control chamber communicates with a low pressure drain, and communication between the accumulator volume and the pressure control chamber is prevented, such that the intensifier arrangement operates to supply fuel to the injector at the second injectable pressure level, and wherein the pressure control chamber is an intermediate chamber of the intensifier arrangement which is defined between opposing ends of the intensifier piston.

2. A fuel injection system as claimed in claim 1, wherein the intensifier piston has a first surface area exposed to fuel pressure within the pressure control chamber and a second surface area exposed to fuel pressure within the intensifier chamber, wherein the first surface area is greater than the second surface area, thereby to permit fuel pressure within the intensifier chamber to be increased to the second injectable pressure level under the control of the intensifier control valve.

3. A fuel injection system as claimed in claim 1, wherein fuel pressure within the intensifier chamber is increased to the second injectable pressure level in circumstances in which fuel pressure within the intermediate chamber is reduced to less than the first injectable pressure level.

4. A fuel injection system as claimed in claim 1, wherein the intensifier control valve means includes a two-position valve member having first and second operating positions, a first operating position in which the valve member is engaged with a first valve seating and disengaged from a second valve seating and a second operating position in which the valve member is disengaged from the first valve seating and is engaged with the second valve seating.

5. A fuel injection system as claimed in claim 4, wherein the valve member is engageable with the second valve seating to control communication between the delivery passage and the pressure control chamber whereby when the valve member is engaged with the second valve seating the delivery passage is unable to communicate with the pressure control chamber and when the valve member is spaced away from the second valve seating the delivery passage is able to communicate with the pressure control chamber.

6. A fuel injection system as claimed in claim 5, wherein the valve member is engageable with the first valve seating to control communication between the pressure control chamber and a low pressure drain whereby when the valve member is engaged with the first valve seating the pressure control chamber is unable to communicate with the low pressure drain and when the valve member is spaced away from the first valve seating the pressure control chamber is able to communicate with the low pressure drain, and whereby in both the first and second operating positions of the valve member the delivery passage is unable to communicate with the low pressure drain.

7. A fuel injection system as claimed in claim 4, wherein the second valve seating is of frusto-conical form.

8. A fuel injection system as claimed in claim 4, wherein the valve member is axially aligned with the intensifier piston.

9. A fuel injection system as claimed in claim 1, wherein the intensifier arrangement is arranged within a common housing with the associated injector.

10. A fuel injection system as claimed in claim 9, wherein the common housing is funned from two or more separate housing parts.

11. A fuel injection system as claimed in claim 1, whereby the accumulator volume is charged with fuel at a first pressure level of around 300 bar, in use.

12. A fuel injection system as claimed in claim 1, whereby the intensifier arrangement is arranged so as to provide fuel at a second pressure level in excess of 2000 bar.

* * * * *